US005599237A

United States Patent [19]

Fetterman et al.

[11] Patent Number: 5,599,237

[45] Date of Patent: Feb. 4, 1997

[54] GOLF BALL DISPENSER WITH PIVOTABLE TEEING DEVICE

[76] Inventors: Robert F. Fetterman, 304 Willowbrooke La., Royersford, Pa. 19468; Robert E. Fetterman, 2477 11th Ave. SW., Largo, Fla. 34640

[21] Appl. No.: 617,549

[22] Filed: Mar. 19, 1996

[51] Int. Cl.[6] ..... A63B 69/36

[52] U.S. Cl. ..... 473/137

[58] Field of Search ..... 473/132, 133, 473/134, 135, 136, 137

[56] References Cited

U.S. PATENT DOCUMENTS

| | | | |
|---|---|---|---|
| 1,940,321 | 12/1933 | Pagett | 473/137 |
| 2,171,299 | 8/1939 | Beckett | 473/137 |
| 3,758,118 | 9/1973 | Willcox | 473/137 |
| 4,796,893 | 1/1989 | Choi | 473/137 |
| 4,957,296 | 9/1990 | Turnidge et al. | 473/137 |
| 5,346,222 | 9/1994 | Luther, Sr. | 473/137 |

*Primary Examiner*—Steven B. Wong

[57] ABSTRACT

A golf ball dispenser with pivotable teeing device which provides a convenient and automatic mechanism to position a golf ball on a tee allowing golfers to hit the ball with their golf club without bending over, the apparatus comprising: a planar base member with a rear edge and a front edge including a golf tee, a cross support being affixed across the base member and including first and second opposing vertical side walls, a block with an angled upper section being affixed to the cross support adjacent to the feed hole, a ball reservoir formed in an elongated hollow configuration with open upper and lower extents, the lower extent being slidably positioned over the rectangular block and coupled against the first vertical side wall by a bracket, the ball reservoir and the first vertical side wall having aligned feed holes, and a ball feed assembly including a retractable lever formed in a generally J-shaped configuration, a spring coupling the retractable lever to the base, a guide ramp including opposing rails formed contiguously with a ball placement ring, the retractable lever and guide ramp being pivotally coupled to the vertical side walls.

5 Claims, 3 Drawing Sheets

GOLF BALL DISPENSER WITH PIVOTABLE TEEING DEVICE

BACKGROUND OF THE INVENTION

1. Field of the Invention

The present invention relates to a golf ball dispenser with pivotable teeing device and more particularly pertains to setting golf balls upon the tee by manually pivoting the retractable lever with a golf club without requiring golfers to bend over or alter their stance.

2. Description of the Prior Art

The use of golf ball dispensing devices is known in the prior art. More specifically, golf ball dispensing devices heretofore devised and utilized for the purpose of dispensing golf balls by using the devices in the suggested manner are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,957,296 to Turnadge a golfball dispenser and teeing device.

U.S. Pat. No. 4,892,318 to Jennings discloses a golfball storage, dispensing and teeing apparatus.

U.S. Pat. No. Des. 344,996 to Nomura discloses a golfball dispensing and teeing machine.

U.S. Pat. No. Des. 351,439 to Halpern discloses a golfball dispenser and teeing machine.

U.S. Pat. No. 5,322,291 to Smith discloses a golf practice apparatus.

Lastly, U.S. Pat. No. 4,995,614 to Tange discloses a golfball dispenser and setter.

In this respect, the golf ball dispenser with pivotable teeing device according to the present invention substantially departs from the conventional concepts and designs of the prior art, and in doing so provides an apparatus primarily developed for the purpose of setting golf balls upon the tee by pivoting the retractable lever with a golf club.

Therefore, it can be appreciated that there exists a continuing need for a new and improved golf ball dispenser with pivotable teeing device which can be used for setting golf balls upon the tee by pivoting the retractable lever with a golf club. In this regard, the present invention substantially fulfills this need.

SUMMARY OF THE INVENTION

In view of the foregoing disadvantages inherent in the known types of golf ball dispensing devices now present in the prior art, the present invention provides an improved golf ball dispenser with pivotable teeing device. As such, the general purpose of the present invention, which will be described subsequently in greater detail, is to provide a new and improved golf ball dispenser with pivotable teeing device and method which has all the advantages of the prior art and none of the disadvantages.

To attain this, the present invention essentially comprises a new and improved golf ball dispenser with pivotable teeing device comprising, in combination: a base member formed in an elongated planar configuration with a linear rear edge, a rounded front edge, a center point, an upper surface and a lower surface, the base having inwardly angled side walls from the center point to the rounded front end, a golf tee being affixed to the rounded front edge of the base, a horizontally positioned cross support being affixed across the upper surface of the base member between the center point and the rear edge, first and second opposing vertical side walls being positioned between the center point and rear edge of the base, each vertical side wall having an inner surface, an outer surface, an upper extent, a lower extent, a front extent and a rear extent, the first vertical sidewall including a feed hole extending therethrough, a rectangular block with an angled upper section being affixed to the cross support adjacent to the feed hole of the first vertical sidewall, a vertically positioned short front wall being affixed to the front extent of the vertical side walls; a ball reservoir formed in an elongated hollow generally rectangular configuration with an open upper extent and an open lower extent, the ball reservoir including a feed hole positioned adjacent the lower extent thereof, the ball reservoir being positioned over the angled upper section of the rectangular block and flush against the first vertical side wall, the feed holes of the ball reservoir and rectangular block being positioned in alignment, a bracket being positioned around the ball support and coupled to the first vertical sidewall to secure the ball support in place; a ball feed assembly including a retractable lever and a ball guide ramp, the retractable lever being formed in a generally J-shaped configuration with a long planar rectangular segment formed contiguously with a short curved segment, the long rectangular segment having a flat upper surface and an outer end including a cushioned pad positioned therearound, a spring having a first end coupled to the upper surface of the retractable lever and a second end coupled to the base adjacent to the rear edge, the short curved segment including a concave upper surface and a front portion having an aperture extending therethrough, the front portion of the short segment also including two slots positioned therein; and the guide ramp including two opposing rails each having a first and a second end, the first end of each opposing rail being affixed within the slots of the short curved segment of the lever, the second end of each rail being formed contiguously with a ball placement ring, the ball feed assembly being pivotally coupled to the front extent of the vertical side walls by an axle positioned through the aperture in the short curved segment of the lever, the upper surface of the short curved segment serving as a ball receiving area being positioned beneath and adjacent to the feed hole in the first vertical side wall, in an operative orientation a plurality of golf balls being inserted through the funnel and positioned within the ball reservoir one above another, the weight of the balls forcing one ball at a time upon the angled upper section of the rectangular block, through the feed hole and into the ball receiving area of the lever, in an operative orientation a user pivoting the retractable lever and guide ramp downwardly with the head of a golf club, the guide ramp being pivoted to a downwardly pitched angle such that the ball placement ring being positioned at a lower vertical height then the first end of the ramp, a golf ball then rolling down the rails of the downwardly pitched ramp and through the ball placement ring and upon the tee, upon release of the retractable lever the spring forcing the retractable lever and guide ramp back to a vertical orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf ball dispenser with pivotable teeing device which has all of the advantages of the prior art golf ball dispensing devices and none of the disadvantages.

It is another object of the present invention to provide a new and improved golf ball dispenser with pivotable teeing device which may be easily and efficiently manufactured and marketed. The present invention has no electronic parts, few moving pieces and requires no installation of any kind.

It is further object of the present invention to provide a new and improved golf ball dispenser with pivotable teeing device which is of durable and reliable constructions.

It is also an object of the present invention to provide a new and improved golf ball dispenser with pivotable teeing device which is portable, relatively maintenance free, reasonably priced and requires no installation costs.

Some other features of the present invention are as follows:

The apparatus is equally good for private use or commercial use, since it can be used at a driving range, at home or with golf instruction.

The apparatus speeds up practice time since no manual teeing is necessary. Users can concentrate on their swing instead of teeing balls, thereby staying in the "groove" of their swing.

The apparatus is very portable and collapsible. It also helps ease tension on the back, legs and knees, thereby causing the user to become less tired during practice time.

An even further object of the present invention is to provide a new and improved golf ball dispenser with pivotable teeing device which is susceptible of a low cost of manufacture with regard to both materials and labor, and which accordingly is then susceptible of low prices of sale to the consuming public, thereby making such golf ball dispenser with pivotable teeing device economically available to the buying public.

Still yet another object of the present invention is to provide a new and improved golf ball dispenser with pivotable teeing device which provides in the apparatuses and methods of the prior art some of the advantages thereof, while simultaneously overcoming some of the disadvantages normally associated therewith.

Still another object of the present invention is setting golf balls upon the tee by manually pivoting the retractable lever with a golf club.

Lastly, it is an object of the present invention to provide a new and improved golf ball dispenser with pivotable teeing device comprising: a golf ball dispenser with pivotable teeing device comprising: a base member formed in a planar configuration with a rear edge and a front edge, a golf tee being affixed to the front edge, a cross support being affixed across the base member, first and second opposing vertical side walls being positioned adjacent to the rear edge of the base, a block with an angled upper section being affixed to the cross support adjacent to the feed hole of the first vertical sidewall; a ball reservoir formed in an elongated hollow configuration with an open upper extent and an open lower extent, the lower extent being positioned over the rectangular block, the ball reservoir being coupled against the first vertical side wall by a bracket, the ball reservoir and the first vertical side wall including aligned feed holes extending therethrough; and a ball feed assembly including a retractable lever formed in a generally J-shaped configuration with a long segment and a short curved segment, a spring having a first end coupled to the retractable lever and a second end coupled to the base adjacent to the rear edge, a guide ramp including opposing rails each having a first and a second end, the first end of each rail being affixed to the short curved segment of the lever, the second end of each rail being formed contiguously with a ball placement ring, the retractable lever and guide ramp being pivotally coupled to the front extent of the vertical side walls.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
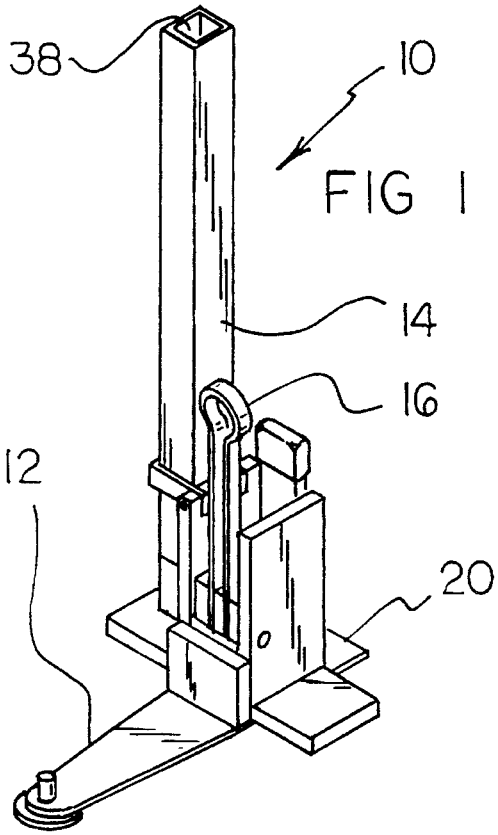
FIG. 1 is a perspective view of the preferred embodiment of the golf ball dispenser with pivotable teeing device constructed in accordance with the principles of the present invention.
Figure 2:
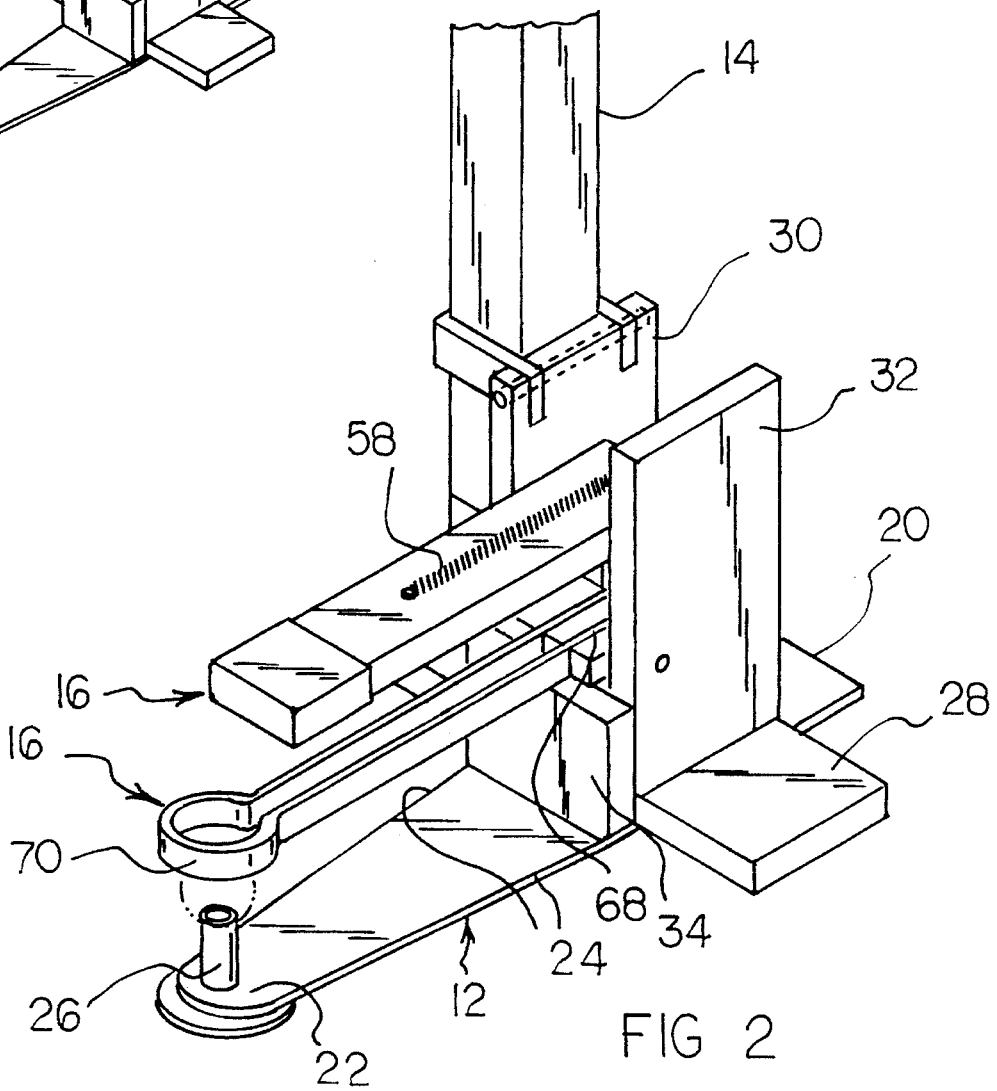
FIG. 2 is a perspective view of the apparatus illustrating the guide ramp and retractable lever positioned in a horizontal orientation.
Figure 3:
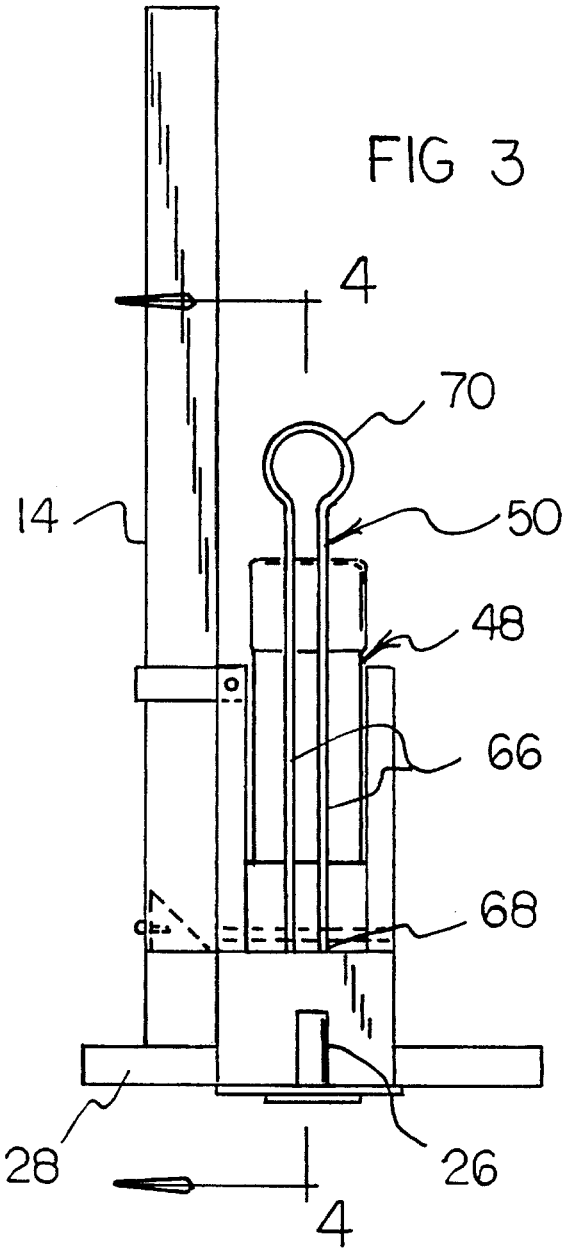
FIG. 3 is a front elevational view of the apparatus illustrating the ball guide ramp positioned in a vertical retracted orientation.
Figure 4:
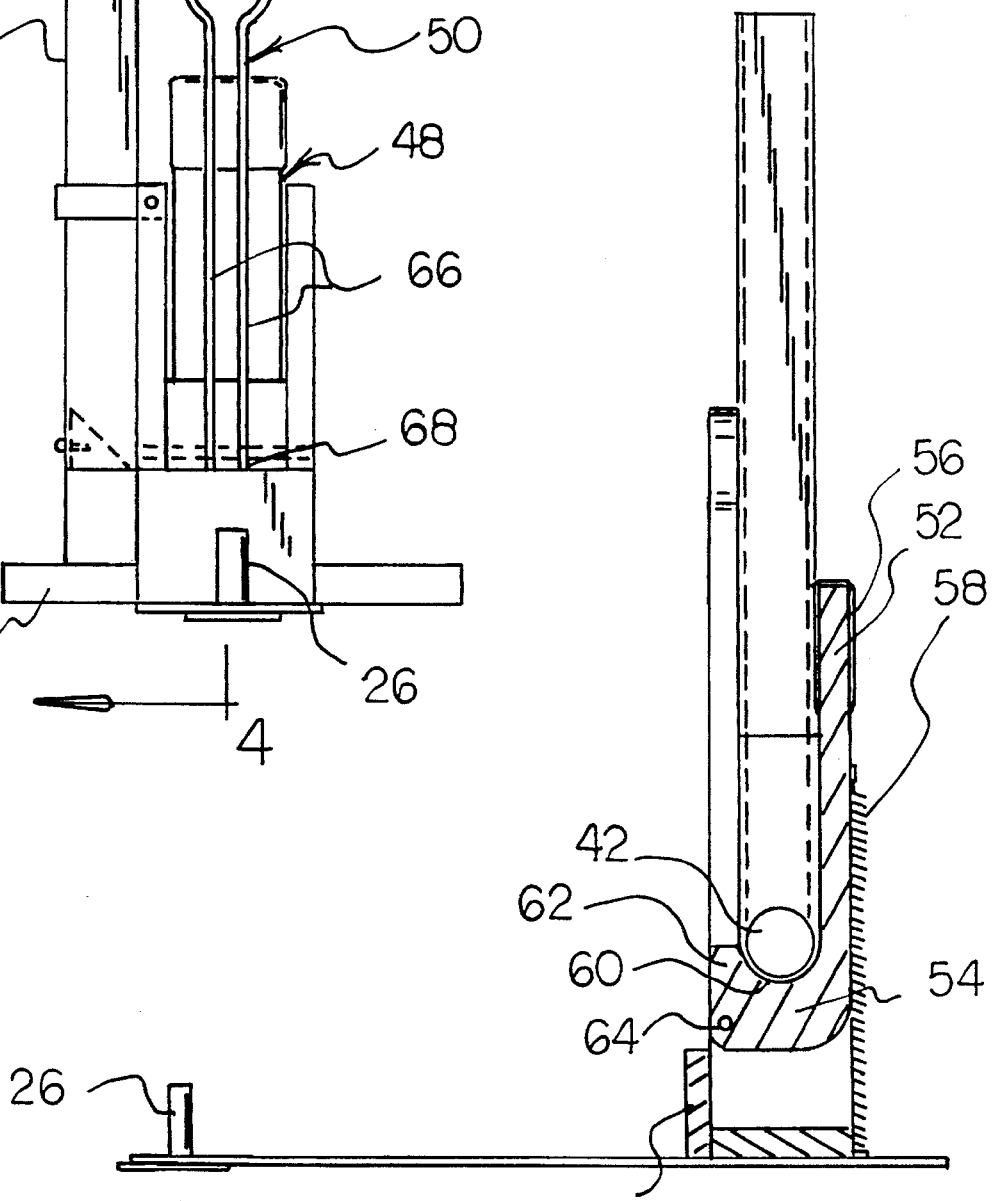
FIG. 4 is a cross-sectional view taken along section line 4—4 of FIG. 3 illustrating the feed hole in the ball reservoir.

With reference now to the drawings, and in particular to FIG. 1 thereof, the preferred embodiment of the new and improved golf ball dispenser with pivotable teeing device embodying the principles and concepts of the present invention and generally designated by the reference numeral 10 will be described.

The present invention, the golf ball dispenser with pivotable teeing device 10 is comprised of a plurality of components. Such components in their broadest context include a base member 12, a ball reservoir 14 and a ball feed assembly 16. Such components are individually configured and correlated with respect to each other so as to attain the desired objective.

More specifically, the base member 12 is formed in an elongated planar configuration with a linear rear edge 20, a rounded front edge 22, a center point, an upper surface and a lower surface. The base may be fabricated of aluminum, wood, rubber, or plastic. The base has inwardly angled side walls 24. Such side walls extend from the center point to the rounded front end 22. The length of the base is about nineteen inches and the width is about ten and one-quarter inches. A golf tee 26 is then affixed to the rounded front end of the base. In addition, a pin is affixed adjacent to the rear edge of the base. A horizontally positioned cross support 28 is then affixed across the upper surface of the base member. Its location is between the center point and the rear edge.

First 30 and second 32 opposing vertical side walls are then positioned between the center point and rear edge of the base. Each vertical side wall has an inner surface, an outer surface, an upper extent, a lower extent, a front extent and a rear extent. The first vertical sidewall includes a feed hole extending through it. A rectangular block with an angled upper section is affixed to the cross support adjacent to the feed hole of the first vertical sidewall. Lastly, a vertically positioned short front wall 34 is affixed to the front extent of the vertical side walls.

The next major component of the system is a ball reservoir 14. The ball reservoir is formed in an elongated hollow generally rectangular configuration with an open upper 38 extent and an open lower extent. The ball reservoir includes a feed hole 42 positioned adjacent its lower extent. The ball reservoir is positioned over the angled upper section of the rectangular block and flush against the first vertical side wall. The feed hole of the ball reservoir and rectangular block are positioned in horizontal alignment. A bracket is positioned around the ball reservoir and coupled to the first vertical sidewall to secure the ball support in place. The bracket includes a screw for tightening or loosening the bracket. The ball reservoir may be easily separated from the apparatus after the bracket has been loosened.

Figure 5:
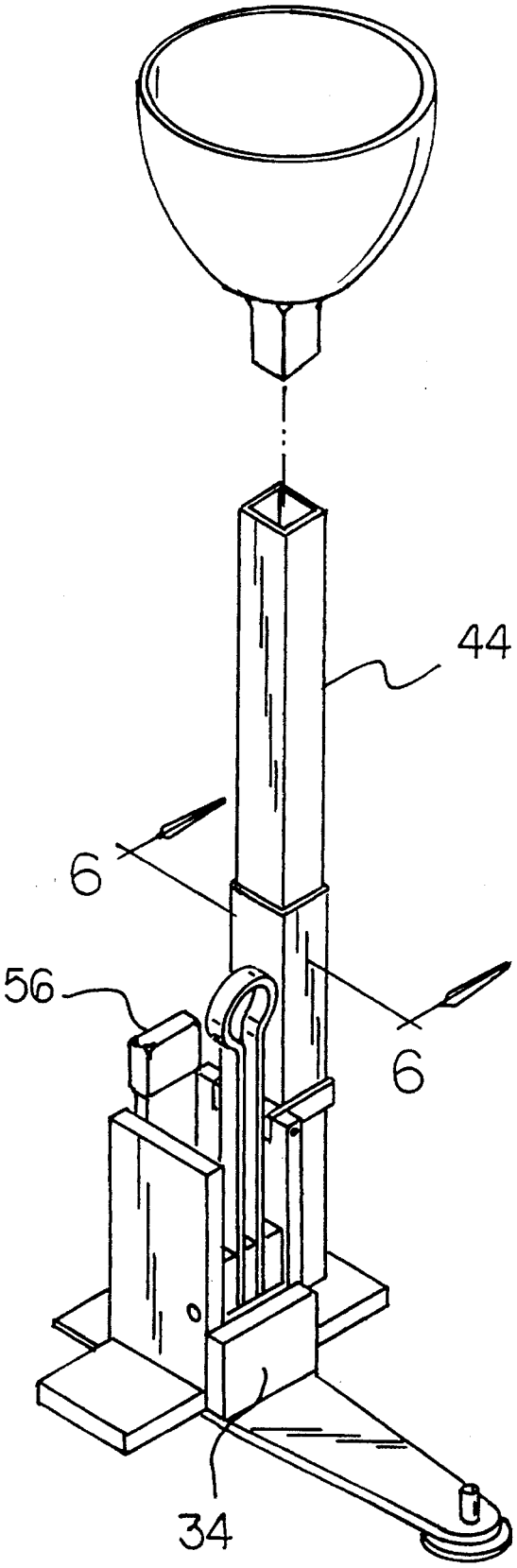
FIG. 5 is a perspective view of an alternate embodiment of the apparatus illustrating the extension member telescopically positioned within the upper end of the reservoir.
Figure 6:
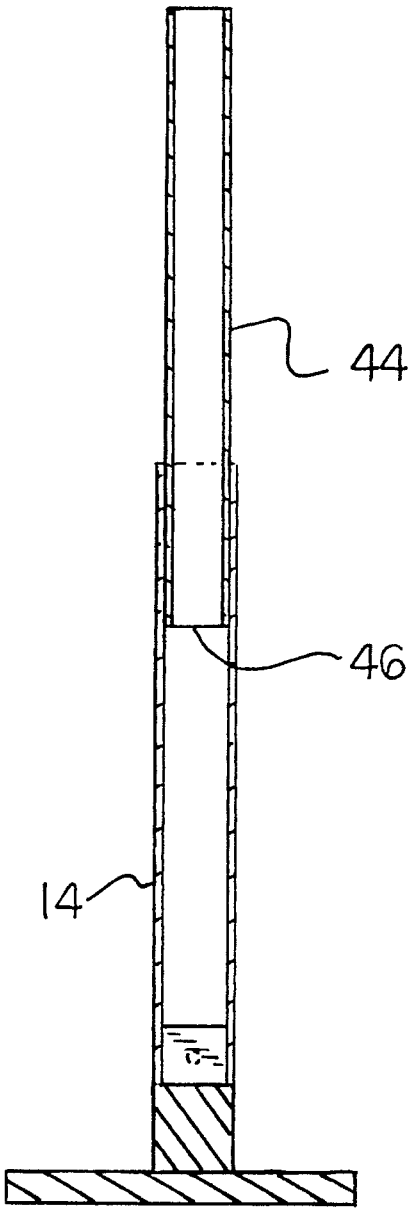
FIG. 6 is a cross-sectional view taken along section line 6—6 of FIG. 5 illustrating the interior structure of the reservoir and extension member.

An alternate embodiment of the apparatus is illustrated in FIGS. 5 and 6. In such embodiment an extension member 44 is formed in a hollow generally rectangular configuration. The extension member has a smaller diameter then the ball reservoir. The extension member has an open upper end and an open lower end 46. The lower end is adjustably couplable within the ball reservoir. The extension member serves to increase the effective height of the ball reservoir. This thereby permits storage of additional golf balls within the apparatus. In its fully extended orientation the extension member increases the length of the shaft from 18–20 inches to 30–40 inches. The ball reservoir can accommodate at least fifteen golf balls. In a further alternate embodiment a funnel is included with the apparatus. Note FIG. 5. In such embodiment the funnel is formed in a generally cylindrical configuration with a large open upper end and a small open rectangular lower end. In use the lower end of the funnel is positioned within the open upper extent of the reservoir to facilitate filling of the reservoir with golf balls.

Next provided is a ball feed assembly 16. Such assembly includes a retractable lever 48 and a ball guide ramp 50. The retractable lever is formed in a generally J-shaped configuration. It includes a long planar rectangular segment 52 which is formed contiguously with a short curved segment 54. The long rectangular segment has a flat upper surface with a pin affixed to it. The long rectangular segment also includes an outer end with a cushioned pad 56 positioned therearound.

In association with the ball feed assembly, a spring 58 is provided having a first end coupled to the pin of the upper surface of the retractable lever. The spring also has a second end coupled to the pin adjacent to the rear edge of the base. The short curved segment includes a concave upper surface 60 and a front portion 62 formed with an aperture extending therethrough. The front portion of the short segment also includes two slots positioned within it.

Lastly provided is the guide ramp 50. The guide ramp includes two opposing rails 66. Each such rail has a first end 68 and a second end. The first end of each opposing rail is affixed within the slots of the short curved segment of the lever. The second end of each rail is formed contiguously with a ball placement ring 70. The ball feed assembly is pivotally coupled to the front extent of the vertical side walls by an axle 64. The axle is positioned through the aperture in the short curved segment of the lever. In alternate embodiments of the apparatus the ball feed assembly is positionable on either side of the ball reservoir to accommodate either left or right handed golfers.

The upper surface of the short curved segment serves as a ball receiving area. Such area is positioned beneath and adjacent to the feed hole in the first vertical side wall. In an operative orientation, a plurality of golf balls are positioned within the ball reservoir one above another. The weight of the balls forces one ball at a time upon the angle upper section of the rectangular block, through the feed hole 42 and into the ball receiving area 60 of the lever. In an operative orientation a user pivots the retractable lever 48 downwardly with the head of a golf club. The guide ramp is pivoted to a downwardly pitched angle such that the ball placement ring 70 becomes positioned at a lower vertical height than the first end of the ramp. A golf ball then rolls down the rails of the downwardly pitched ramp and through the ball placement ring and upon the tee 26. This occurs upon release of the retractable lever with the spring 58 thereafter forcing the retractable lever and guide ramp back to a vertical orientation.

In one alternate embodiment of the apparatus a flip down handle is included on the ball reservoir to facilitate transport of the apparatus. In another alternate embodiment a carry bag is included to facilitate transport of the apparatus along with other golf accessories. In a further alternate embodiment a coin operated device is operatively coupled to the apparatus to permit coin activated operation at commercial venues such as golf courses and driving ranges.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved golf ball dispenser with pivotable teeing device comprising, in combination:

a base member formed in an elongated planar configuration with a linear rear edge, a rounded front edge, a center point, an upper surface and a lower surface, the base having inwardly angled side walls from the center point to the rounded front end, a golf tee being affixed to the rounded front edge of the base, a horizontally positioned cross support being affixed across the upper surface of the base member between the center point and the rear edge, first and second opposing vertical side walls being positioned between the center point and rear edge of the base, each vertical side wall having an inner surface, an outer surface, an upper extent, a lower extent, a front extent and a rear extent, the first vertical sidewall including a feed hole extending therethrough, a rectangular block with an angled upper section being affixed to the cross support adjacent to the feed hole of the first vertical sidewall, a vertically positioned short front wall being affixed to the front extent of the vertical side walls;

a ball reservoir formed in an elongated hollow generally rectangular configuration with an open upper extent and an open lower extent, the ball reservoir including a feed hole positioned adjacent the lower extent thereof, the ball reservoir being positioned over the angled upper section of the rectangular block and flush against the first vertical side wall, the feed hole of the ball reservoir and rectangular block being positioned in alignment, a bracket being positioned around the ball support and coupled to the first vertical sidewall to secure the ball support in place;

a ball feed assembly including a retractable lever and a ball guide ramp, the retractable lever being formed in a generally J-shaped configuration with a long planar rectangular segment formed contiguously with a short curved segment, the long rectangular segment having a flat upper surface and an outer end including a cushioned pad positioned therearound, a spring having a first end coupled to the upper surface of the retractable lever and a second end coupled to the base adjacent to the rear edge, the short curved segment including a concave upper surface and a front portion having an aperture extending therethrough, the front portion of the short segment also including two slots positioned therein; and the guide ramp including two opposing rails each having a first and a second end, the first end of each opposing rail being affixed within the slots of the short curved segment of the lever, the second end of each rail being formed contiguously with a ball placement ring, the ball feed assembly being pivotally coupled to the front extent of the vertical side walls by an axle positioned through the aperture in the short curved segment of the lever, the upper surface of the short curved segment serving as a ball receiving area being positioned beneath and adjacent to the feed hole in the first vertical side wall, in an operative orientation a plurality of golf balls being positioned within the ball reservoir one above another, the weight of the balls forcing one ball at a time upon the angled upper section of the rectangular block, through the feed hole and into the ball receiving area of the lever, in an operative orientation a user pivoting the retractable lever and guide ramp downwardly with the head of a golf club, the guide ramp being pivoted to a downwardly pitched angle such that the ball placement ring being positioned at a lower vertical height then the first end of the ramp, a golf ball then rolling down the rails of the downwardly pitched ramp and through the ball placement ring and upon the tee, upon release of the retractable lever the spring forcing the retractable lever and guide ramp back to a vertical orientation.

2. A golf ball dispenser with pivotable teeing device comprising:

a base member formed in a planar configuration with a rear edge and a front edge, a golf tee being affixed to the front edge, a cross support being affixed across the base member, first and second opposing vertical side walls being positioned adjacent to the rear edge of the base, a block with an angled upper section being affixed to the cross support adjacent to the feed hole of the first vertical sidewall;

a ball reservoir formed in an elongated hollow configuration with an open upper extent and an open lower extent, the lower extent being positioned over the block, the ball reservoir being coupled against the first vertical side wall by a bracket, the ball reservoir and the first vertical side wall including aligned feed holes extending therethrough; and a ball feed assembly including a retractable lever formed in a generally J-shaped configuration with a long segment and a short curved segment, a spring having a first end coupled to the retractable lever and a second end coupled to the base adjacent to the rear edge, a guide ramp including opposing rails each having a first and a second end, the first end of each rail being affixed to the short curved segment of the lever, the second end of each rail being formed contiguously with a ball placement ring, the retractable lever and guide ramp being pivotally coupled to the front extent of the vertical side walls.

3. The apparatus as set forth in claim 2 and further including:

a funnel formed in a generally cylindrical configuration with a large open upper end and a small open rectangular lower end, the lower end of the funnel being positioned within the open upper extent of the reservoir in an operative orientation.

4. The apparatus as set forth in claim 2 wherein the long segment of the retractable lever has an outer end including a cushioned pad positioned therearound.

5. The apparatus as set forth in claim 2 and further including:

an extension member formed in a hollow generally rectangular configuration, the extension member having a smaller diameter then the ball reservoir, the extension member having an open upper end and an open lower end with coupling means, the lower end being adjustably couplable within the ball reservoir.

* * * * *